US010213040B1

(12) United States Patent
McCoy

(10) Patent No.: US 10,213,040 B1
(45) Date of Patent: Feb. 26, 2019

(54) FOLDABLE LIGHTED TREE ASSEMBLY

(71) Applicant: Mark McCoy, Monroe, LA (US)

(72) Inventor: Mark McCoy, Monroe, LA (US)

( * ) Notice: Subject to any disclaimer, the term of this patent is extended or adjusted under 35 U.S.C. 154(b) by 35 days.

(21) Appl. No.: 15/227,105

(22) Filed: Aug. 3, 2016

Related U.S. Application Data

(60) Provisional application No. 62/201,636, filed on Aug. 6, 2015.

(51) Int. Cl.

| | |
|---|---|
| ***F21S 6/00*** | (2006.01) |
| ***A47G 33/06*** | (2006.01) |
| ***F21V 33/00*** | (2006.01) |
| ***F21S 4/10*** | (2016.01) |
| ***F21V 21/30*** | (2006.01) |

(52) U.S. Cl.
CPC ..... *A47G 33/06* (2013.01); *F21S 4/10* (2016.01); *F21V 21/30* (2013.01); *F21V 33/0028* (2013.01)

(58) Field of Classification Search
CPC . A47G 33/06; F21S 4/10; F21V 21/30; F21V 33/0028
USPC ..... 362/123
See application file for complete search history.

(56) References Cited

U.S. PATENT DOCUMENTS 5,359,502 A * 10/1994 Cantin ..... A47G 33/06 362/123
6,162,515 A * 12/2000 Hill ..... A47G 33/06 211/196

* cited by examiner

*Primary Examiner* — Elmito Breval
*Assistant Examiner* — Meghan Ulanday
(74) *Attorney, Agent, or Firm* — R. Keith Harrison

(57) ABSTRACT

A foldable lighted tree assembly includes an assembly frame with a plurality of elongated assembly frame legs each having a first leg end and a second leg end. The plurality of assembly frame legs converges at the second leg end. The plurality of assembly frame legs are selectively deployable between an extended, functional configuration wherein the assembly frame is generally pyramid-shaped and a folded, non-functional transport and storage configuration wherein the plurality of assembly frame legs are generally parallel and adjacent to each other. At least one light string having a plurality of lights is supported by the assembly frame.

5 Claims, 11 Drawing Sheets

FOLDABLE LIGHTED TREE ASSEMBLY

CROSS-REFERENCE TO RELATED APPLICATIONS

This application claims the benefit of U.S. provisional application No. 62/201,636, filed Aug. 6, 2015 and entitled FOLDABLE CHRISTMAS TREE, which provisional application is hereby incorporated by reference herein in its entirety.

FIELD

Illustrative embodiments of the disclosure generally relate to decorative lighted trees such as Christmas trees. More particularly, illustrative embodiments of the disclosure relate to a foldable lighted tree assembly which can be readily deployed for use and folded for transport and/or storage.

SUMMARY

Illustrative embodiments of the disclosure are generally directed to a foldable lighted tree assembly which can be readily deployed for use and folded for transport and/or storage. An illustrative embodiment of the foldable lighted tree assembly includes an assembly frame with a plurality of elongated assembly frame legs each having a first leg end and a second leg end. The plurality of assembly frame legs converges at the second leg end. The plurality of assembly frame legs are selectively deployable between an extended, functional configuration wherein the assembly frame is generally pyramid-shaped and a folded, non-functional transport and storage configuration wherein the plurality of assembly frame legs are generally parallel and adjacent to each other. At least one light string having a plurality of lights is supported by the assembly frame.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "Left", "rear", "right", "front", "vertical", "horizontal", and derivatives thereof shall relate to the invention as oriented in FIG. 1. Furthermore, there is no intention to be bound by any expressed or implied theory presented in the preceding technical field, backsupporting surface, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
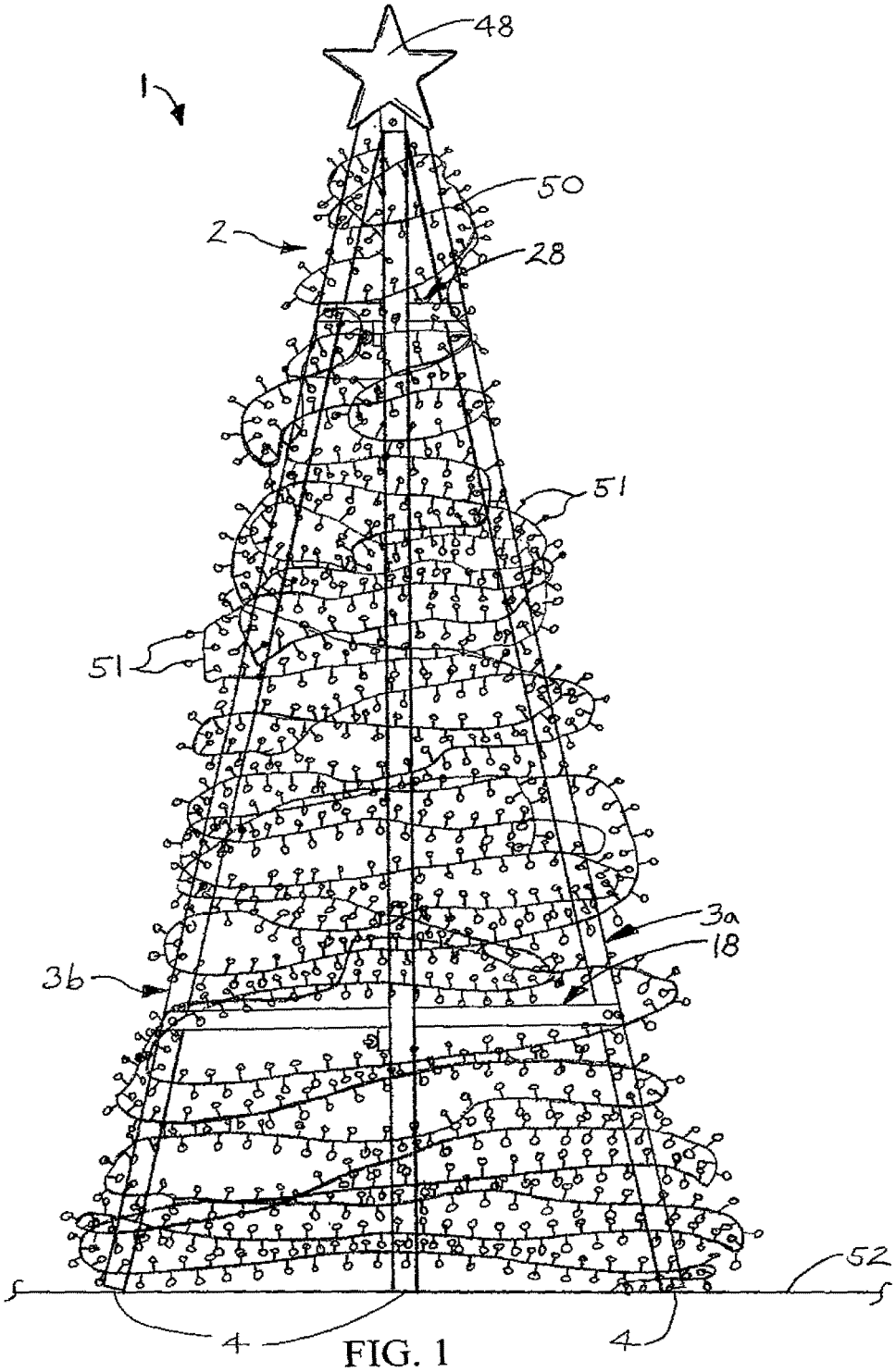
FIG. 1 is a front view of an illustrative embodiment of the foldable lighted tree assembly, deployed in a functional configuration on a supporting surface in typical application of the assembly.
Figure 2:
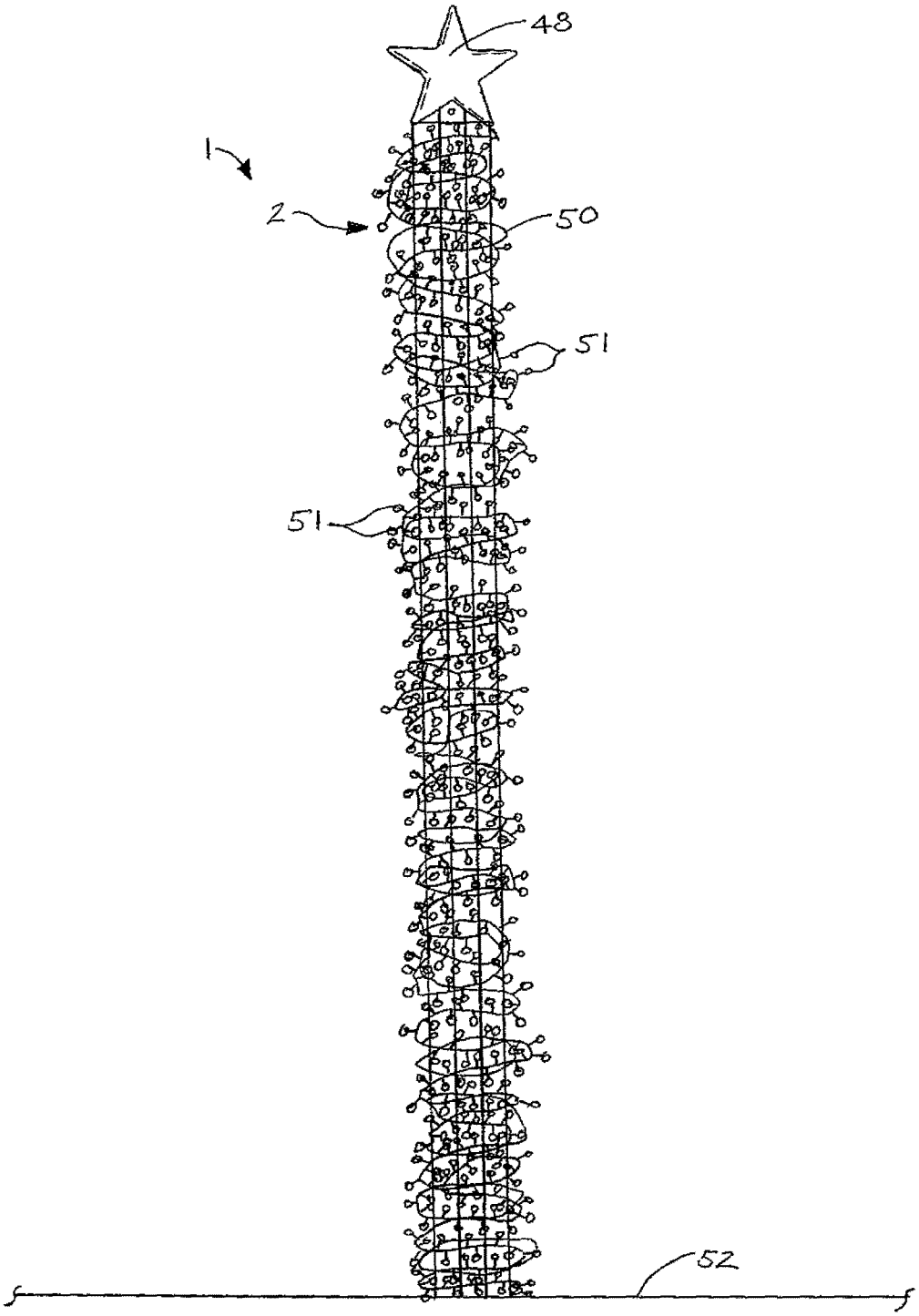
FIG. 2 is a front view of the foldable lighted tree assembly, deployed in a folded configuration preparatory to transport or stowage of the assembly.

Referring to the drawings, an illustrative embodiment of the foldable lighted tree assembly, hereinafter assembly, is generally indicated by reference numeral 1. As illustrated in FIGS. 1 and 2, the assembly 1 may include a foldable assembly frame 2. At least one light string 50 having multiple light bulbs 51 may be distributed over the assembly frame 2. The assembly frame 2 may be configured for expeditious deployment in an extended, functional configuration on the ground or other supporting surface 52, as illustrated in FIG. 1, or in a folded, transport or stowage configuration, as illustrated in FIG. 2. In typical application of the assembly 1, which will be hereinafter further described, the assembly frame 2 can be deployed on the supporting surface 52 in the extended, functional configuration of FIG. 1 in a yard, building or other area. The light string or strings 50 can be plugged into a suitable electrical source (not illustrated) to energize and illuminate the light bulbs 51 on the light string 50 and provide a festive seasonal decoration. After use, the assembly 1 can be readily deployed in the folded configuration, as illustrated in FIG. 2, for space-efficient transport and/or storage of the assembly 1.

Figure 14:
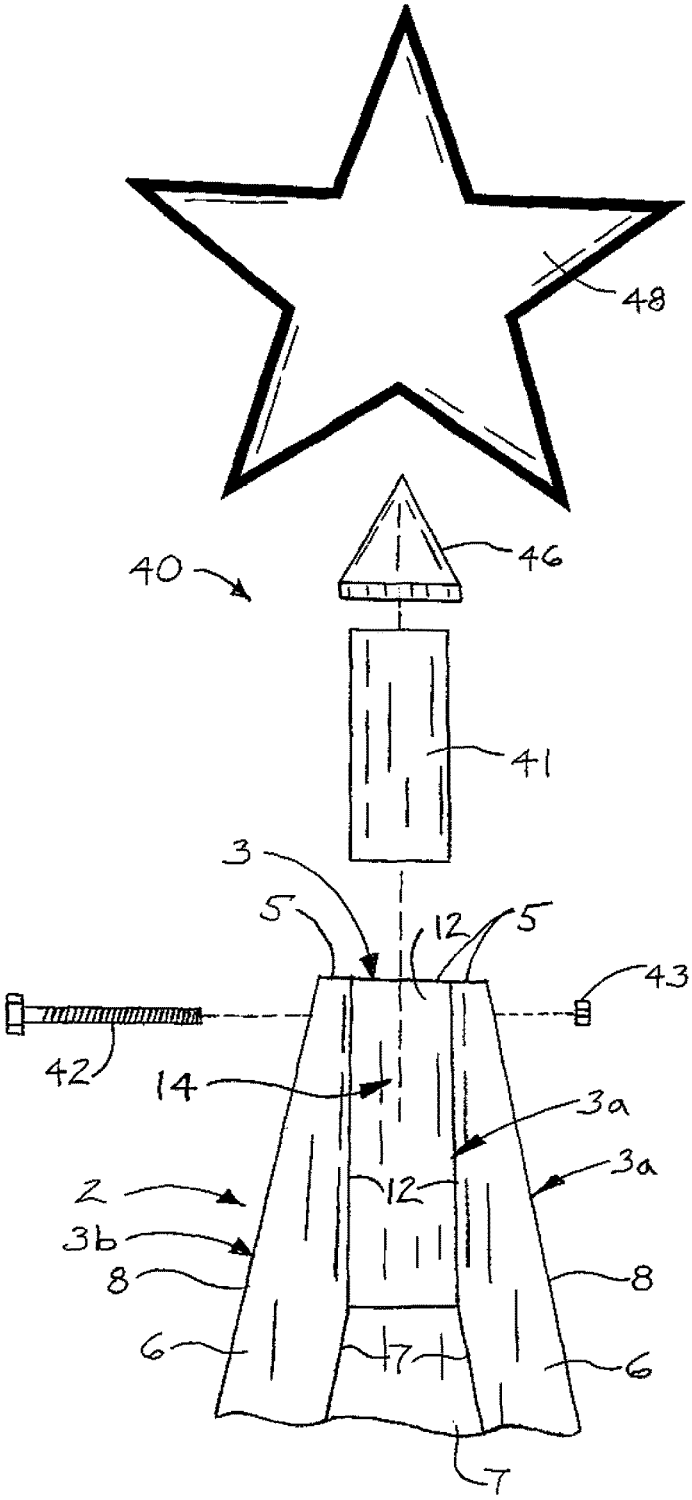
FIG. 14 is an exploded front view of a typical decoration mount assembly which is suitable for mounting a decoration on the assembly frame in implementation of the foldable lighted tree assembly.
Figure 15:
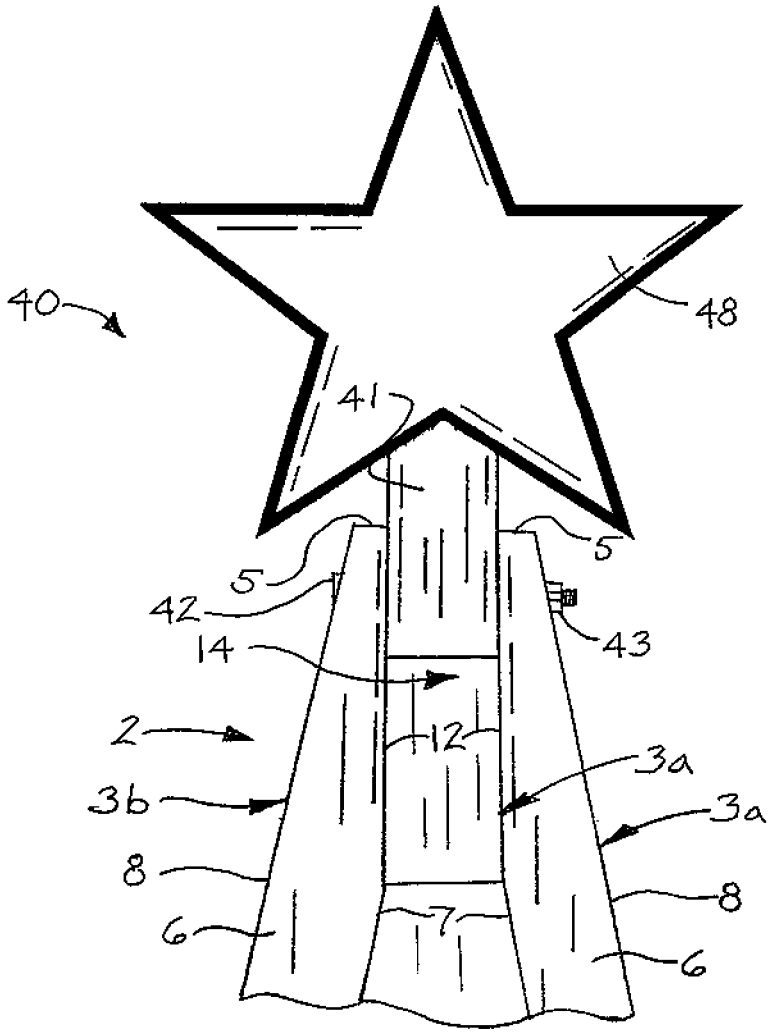
FIG. 15 is a front view of the assembled decoration mount assembly.

Referring next to FIGS. 3-15 of the drawings, the assembly frame 2 of the assembly 1 may include at least three elongated assembly frame legs 3*a*, 3*b*. In some embodiments, the assembly frame 2 may include four assembly frame legs 3*a*, 3*b* which are disposed in a pyramid-shaped configuration in the functional, extended configuration of the assembly frame 2. The assembly frame 2 may be fabricated of wood, plastic, metal, composite materials or any combination thereof. Each assembly frame leg 3*a*, 3*b* may have a lower leg end 4, as illustrated in FIG. 5, and an upper leg end 5, as illustrated in FIG. 14. In the extended, functional configuration, the assembly frame legs 3*a*, 3*b* may converge at the upper leg end 5 and impart a generally pyramid shape to the assembly frame 2. In typical application of the assembly 1, the lower end leg 5 of each frame leg 3*a*, 3*b* rests on the supporting surface 52. Each assembly frame leg 3*a*, 3*b* may have a pair of side leg surfaces 6, an inner leg surface 7 which faces the other assembly frame legs 3*a*, 3*b* and an outer leg surface 8 which is opposite the inner leg surface 7. As illustrated in FIGS. 14 and 15, and in some embodiments, a leg bevel 12 may be provided in the inner leg surface 7 adjacent to the upper leg end 5 of each assembly frame leg 3*a*, 3*b* for purposes which will be hereinafter described. A mount block cavity 14 may be formed by and between the leg bevels 12 of the respective assembly frame legs 3*a*, 3*b*.

Figure 3:
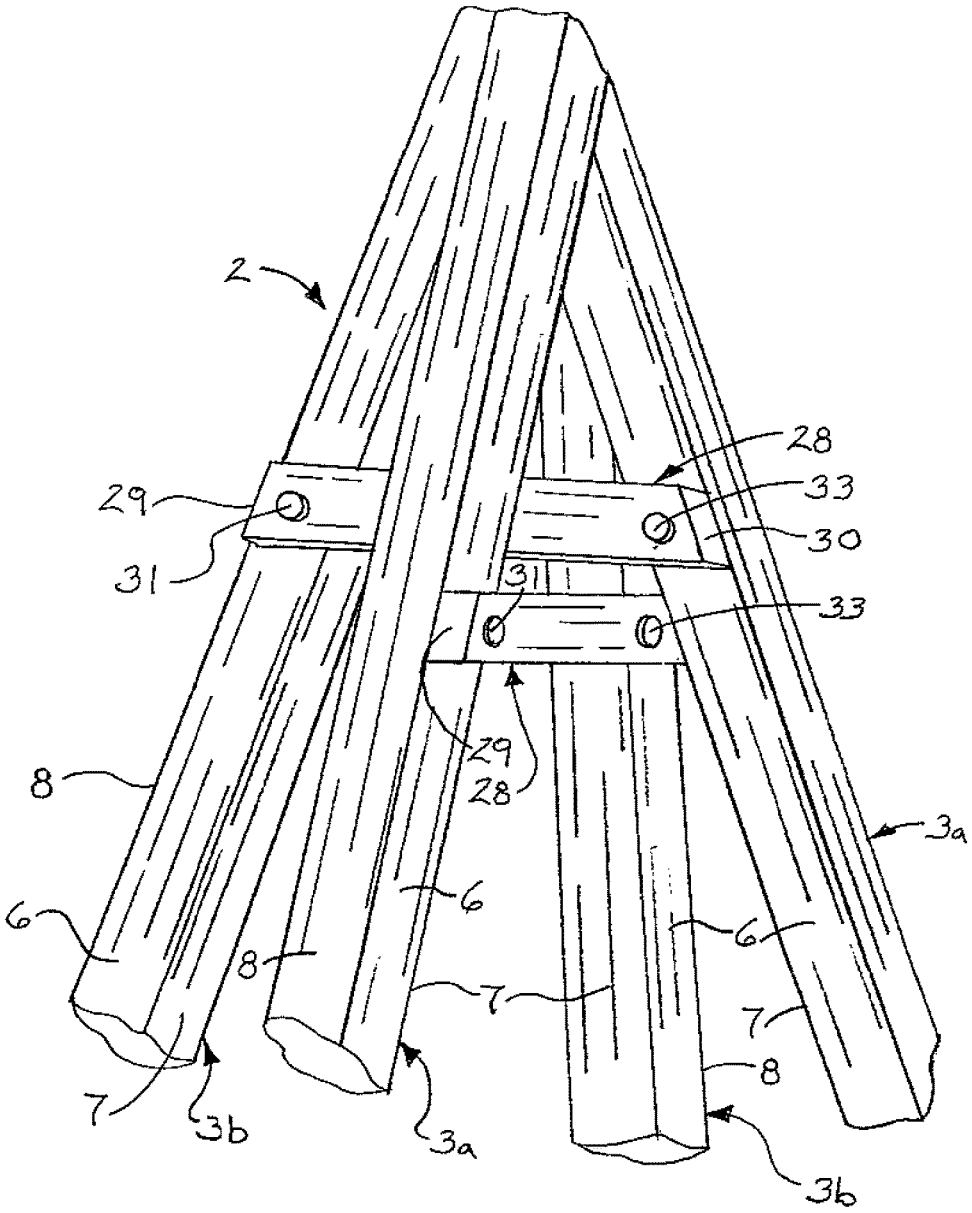
FIG. 3 is a perspective view, partially in section, of an upper portion of an assembly frame of the foldable lighted tree, with a pair of upper frame members connecting opposing pairs of frame legs in the assembly frame.
Figure 4:
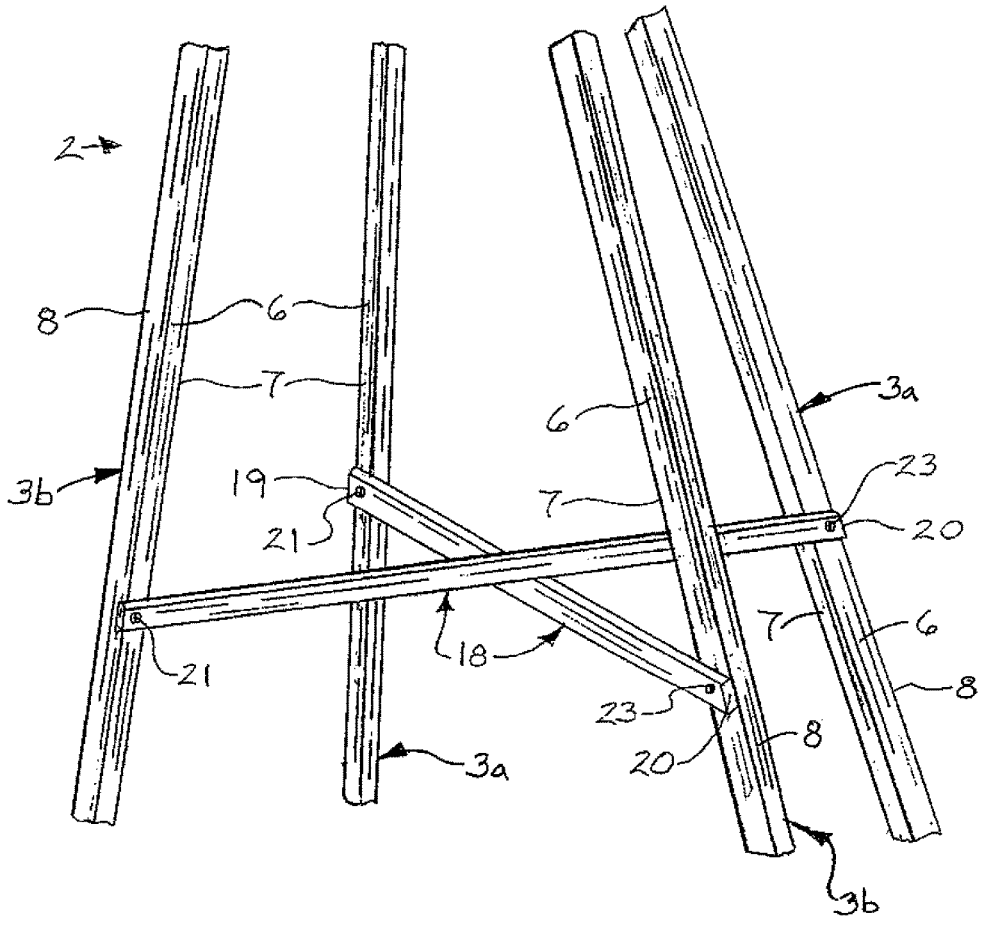
FIG. 4 is a bottom view, partially in section, of a lower portion of the assembly frame, with a pair of lower frame members connecting the opposing pairs of frame legs in the assembly frame.
Figure 5:
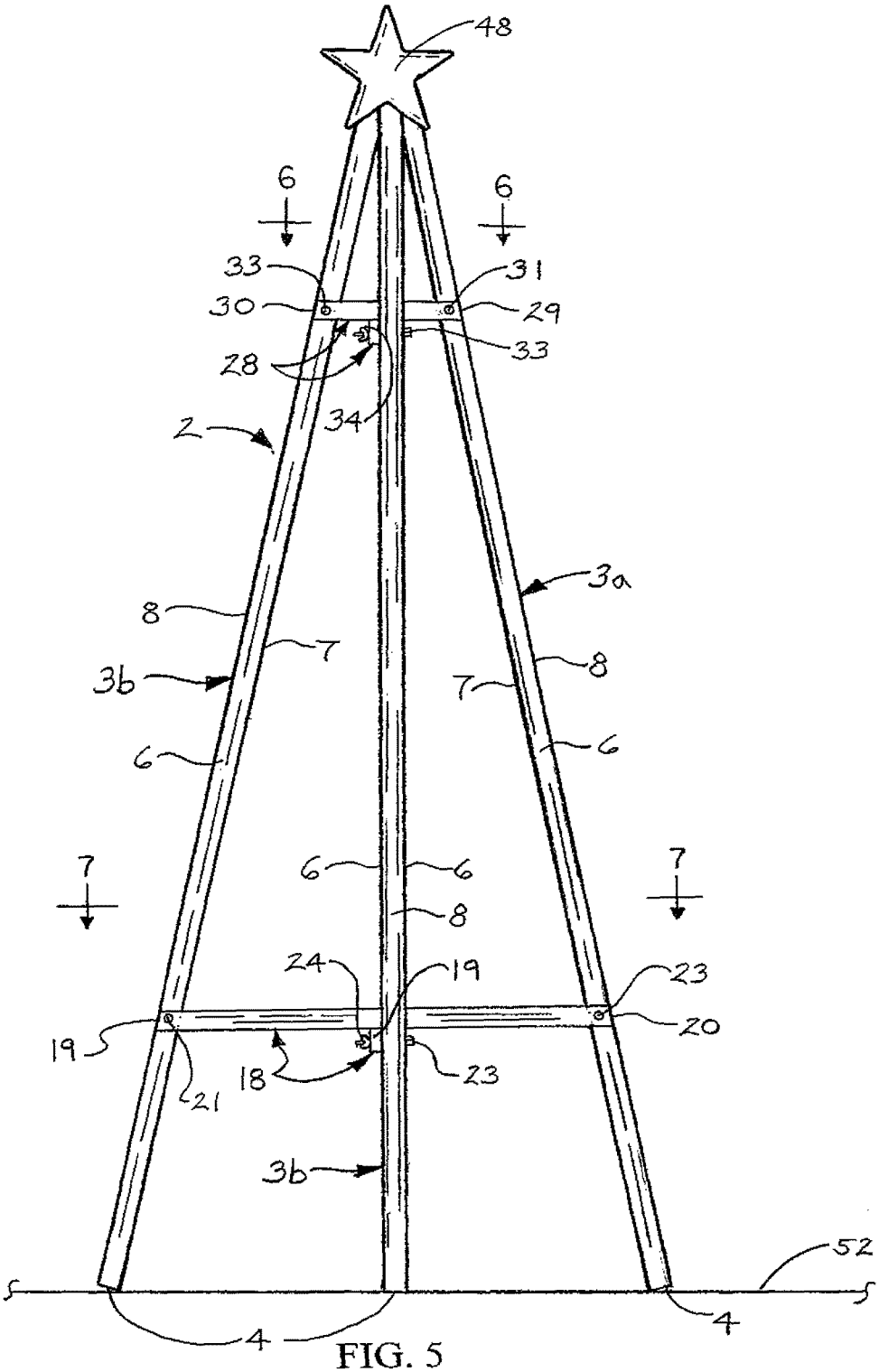
FIG. 5 is a front view of the assembly frame deployed in the extended, functional position on the supporting surface.

As further illustrated in FIGS. 4 and 5, in some embodiments, a pair of lower frame stabilizing members 18 may releasably connect opposing pairs of the assembly frame legs 3*a*, 3*b* in the assembly frame 2. As illustrated in FIGS. 3 and 5, a pair of upper frame stabilizing members 28 may, in like manner, additionally or alternatively releasably connect opposing pairs of the assembly frame legs 3*a*. 3*b*. The lower frame stabilizing members 18 and the upper frame stabilizing members 28 may facilitate selective deployment of the assembly frame 2 in the extended, functional position illustrated in FIG. 5 or in the folded, non-functional transport or storage configuration illustrated in FIG. 12.

As illustrated in FIGS. 6-11, in some embodiments, the assembly frame 2 may include two pairs of opposing assembly frame legs 3*a*, 3*b* which are disposed in planes that are oriented in perpendicular and intersecting relationship to each other. Each opposing pair of assembly frame legs 3*a*, 3*b* is designated as a pivot assembly frame leg 3*a* and a release assembly frame leg 3*b*. Thus, each lower frame stabilizing member 18 and each upper frame stabilizing member 28 may releasably connect a corresponding pair of the pivot assembly frame leg 3*a* and release assembly frame leg 3*b*.

Figure 6:
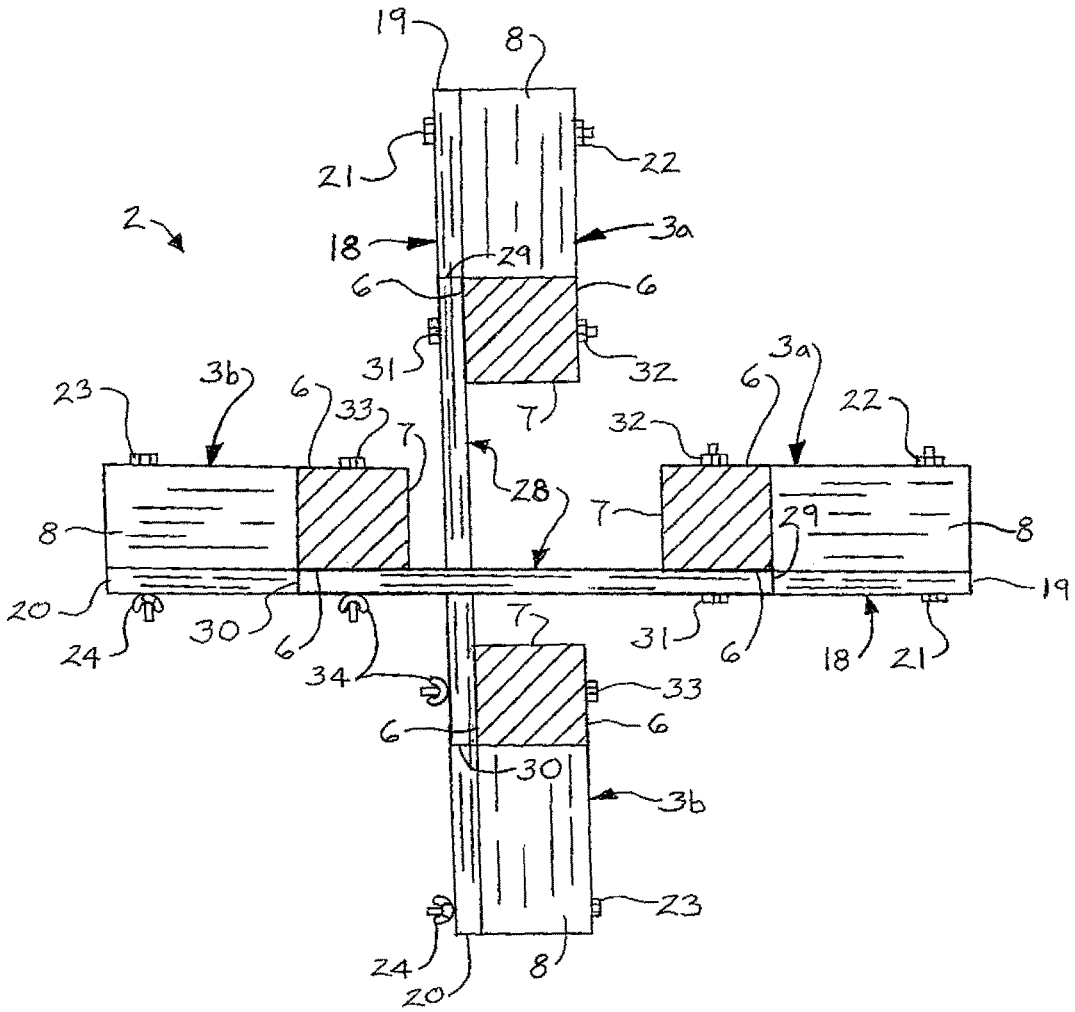
FIG. 6 is a sectional view, taken along section lines 6-6 in FIG. 5, of the upper portion of the assembly frame.
Figure 7:
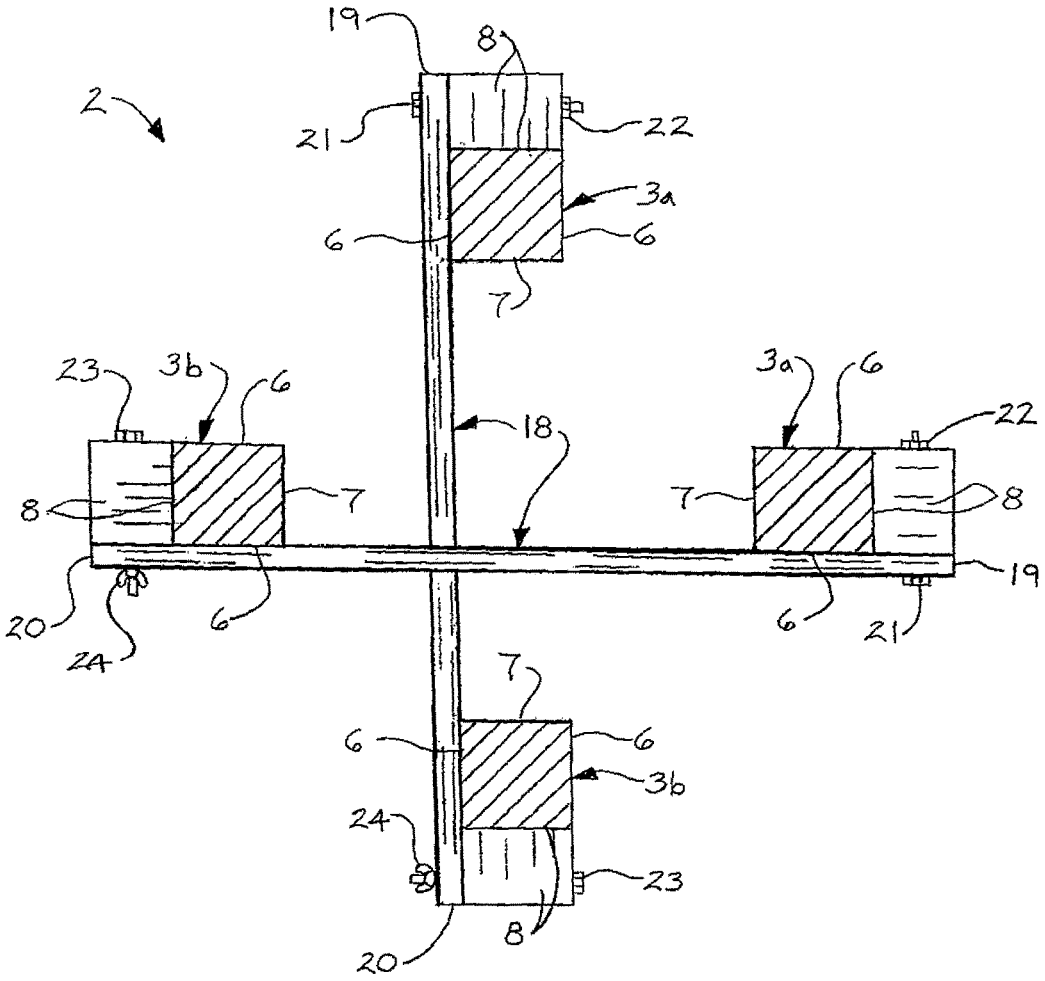
FIG. 7 is a sectional view, taken along section lines 7-7 in FIG. 5, of the lower portion of the assembly frame.
Figure 10:
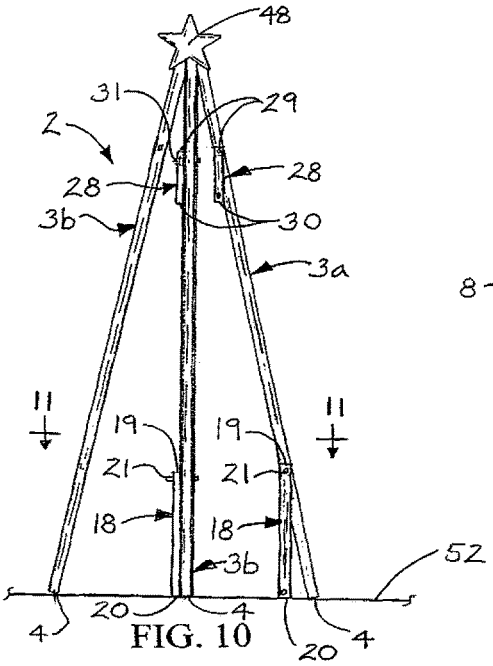
FIG. 10 is a front view of the extended and deployed assembly frame, with both the upper frame members and the lower frame members in the released position preparatory to folding of the assembly frame.
Figure 11:
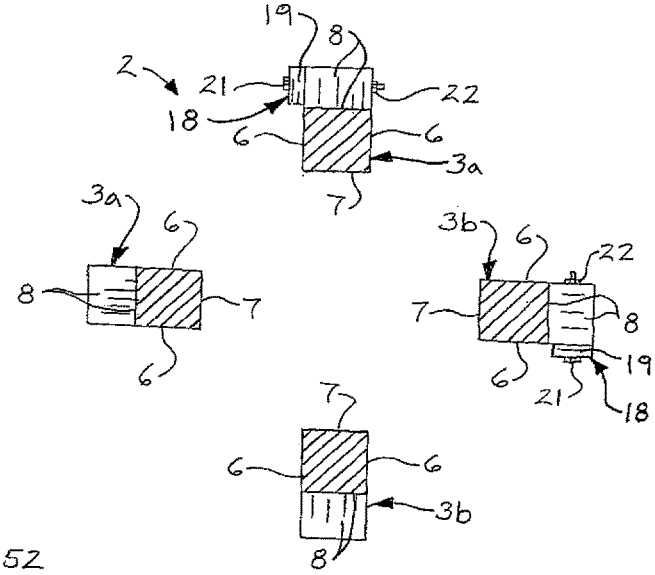
FIG. 11 is a sectional view, taken along section lines 11-11 in FIG. 10, of the lower portion of the assembly frame with the released lower frame members.
Figure 12:
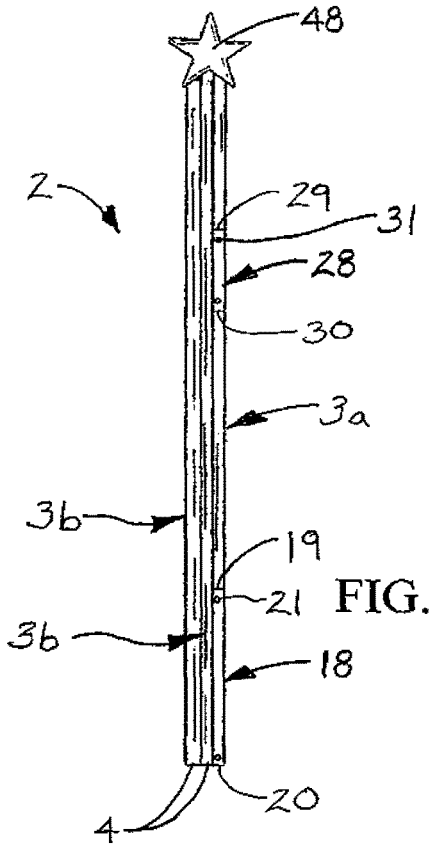
FIG. 12 is a front view of the assembly frame in the folded configuration preparatory to transport or stowage.

As illustrated in FIGS. 6 and 7, each lower frame stabilizing member 18 may be generally elongated and may have a pivot end 19 which is pivotally attached to the pivot assembly frame leg 3*a* and a release end 20 which is releasably attached to the opposing release assembly frame leg 3*b* of each corresponding pair of opposing assembly frame legs 3*a*, 3*b*. The pivot end 19 of each lower frame stabilizing member 18 may be pivotally attached to the corresponding pivot assembly frame leg 3*a* according to any suitable technique which is known by those skilled in the art. Accordingly, as illustrated in FIGS. 6 and 7, in some embodiments, a pivot bolt 21, secured by a pivot bolt nut 22, may pivotally attach the pivot end 19 of each lower frame stabilizing member 18 to a side leg surface 6 of the corresponding pivot assembly frame leg 3*a*. The release end 20 of each lower frame stabilizing member 18 may be releasably attached to the corresponding opposing release assembly frame leg 3*b* according to any suitable technique which is known by those skilled in the art. As further illustrated in FIGS. 6 and 7, in some embodiments, a release bolt 23, secured with a wing nut 24, may secure the release end 20 of each lower frame stabilizing member 18 to a side leg surface 6 of the corresponding release assembly frame leg 3*b*. As illustrated in FIGS. 10 and 11, the release end 20 of each lower frame stabilizing member 18 can be selectively detached from the corresponding release assembly frame leg 3*b*, typically by removal of the wing nut 24 and release bolt 23, preparatory to folding the assembly frame 2 into the non-functional, transport or stowage position illustrated in FIG. 2.

As illustrated in FIGS. 3 and 5, the assembly frame 2 may additionally or alternatively include the pair of upper frame stabilizing members 28 which connect the corresponding opposing pairs of the pivot assembly frame legs 3*a* and release assembly frame legs 3*b* in the assembly frame 2 in intersecting relationship to each other. As illustrated in FIG. 6, each upper frame stabilizing member 28 may be generally elongated with a pivot end 29 and a release end 30. A pivot bolt 31, secured with a pivot bolt nut 32, may pivotally attach the pivot end 29 of each upper frame stabilizing member 28 to a corresponding pivot assembly frame leg 3*a*. A release bolt 33, secured with a wing nut 34, may releasably secure the release end 30 of each upper frame stabilizing member 28 to a corresponding opposing release assembly frame leg 3*b* in the assembly frame 2. Accordingly, as illustrated in FIG. 5, the upper frame stabilizing members 28 may additionally secure the assembly frame legs 3*a*, 3*b* of the assembly frame 2 in the extended, functional configuration in the same manner as the lower frame stabilizing members 18. The release end 30 of each upper frame stabilizing member 28 may be selectively detached from the corresponding release assembly frame leg 3*b* typically by removal of the release bolt 33 and wing nut 34 to facilitate deployment of the assembly frame 2 from the extended, functional configuration illustrated in FIG. 5 to the folded, transport or stowage configuration illustrated in FIG. 12.

Figure 8:
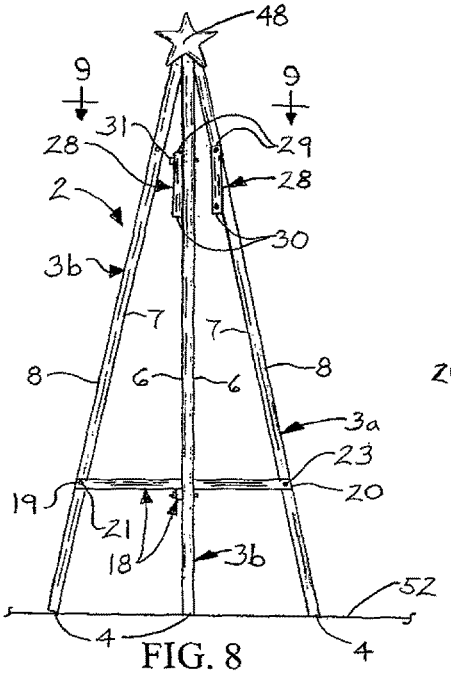
FIG. 8 is a front view of the extended and deployed assembly frame, with the pair of upper frame members in a released position and the pair of lower frame members in a deployed position preparatory to folding of the assembly frame for transport and/or storage.
Figure 9:
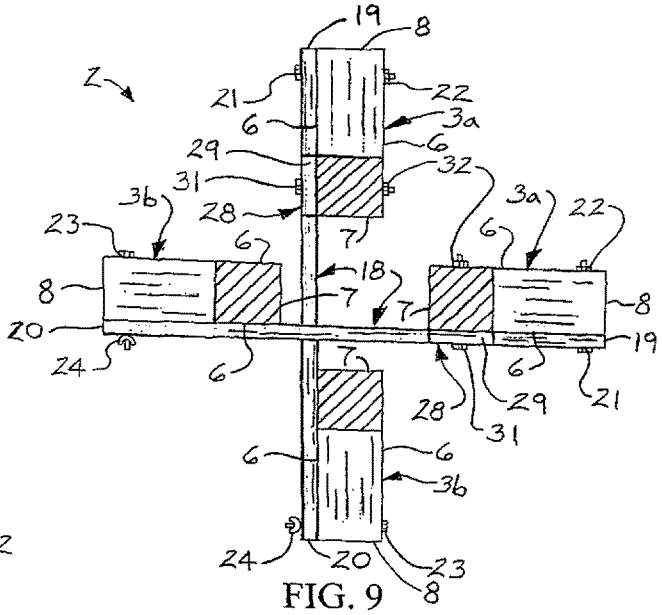
FIG. 9 is a sectional view, taken along section lines 9-9 in FIG. 8, of the upper portion of the assembly frame with the released upper frame members and deployed lower frame members.
Figure 13:
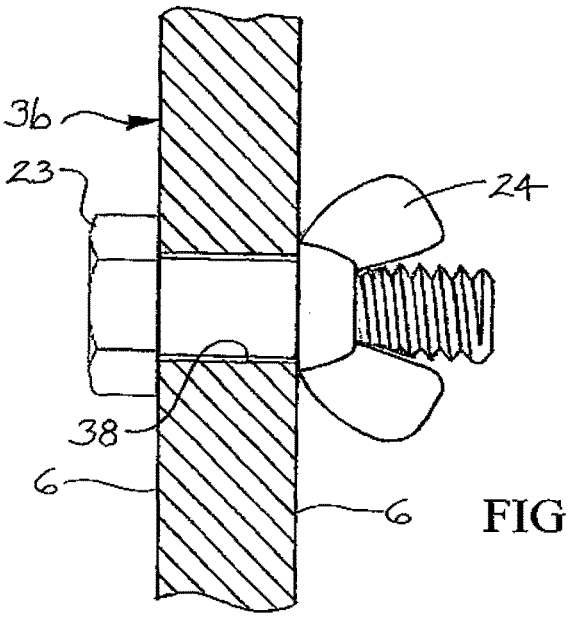
FIG. 13 is a sectional view of a portion of an assembly frame leg of the assembly frame, more particularly illustrating a bolt stowage opening extending through the assembly frame leg, a release bolt extending through the bolt stowage opening and a wing nut threaded on the release bolt in stowage of the release bolt after release of the upper frame members and the lower frame members.

As illustrated in FIG. 13, in some embodiments, at least one bolt stowage opening 38 may extend through each release assembly frame leg 3*b*, as illustrated, and/or each pivot assembly frame leg 3*a* of the assembly frame 2. After release of each lower frame stabilizing member 18 from the corresponding release assembly frame leg 3*b*, as illustrated in FIGS. 10 and 11, the release bolt 23 of each lower frame stabilizing member 18 may be extended through the bolt stowage opening 38 and secured with the wing nut 24. In like manner, additional bolt stowage openings 38 may be provided in each release assembly frame leg 3*b* and/or each pivot assembly frame leg 3*a* to accommodate the release bolt 33 and wing nut 34 of each upper frame stabilizing member 28 after release of each upper frame stabilizing member 28 from the corresponding release assembly frame leg 3*b*, as illustrated in FIGS. 8 and 9.

As illustrated in FIGS. 14 and 15, in some embodiments, a decoration 48 such as a star, as illustrated, or other figure such as an angel, for example and without limitation, may be provided on the upper end of the assembly frame 2 for decorative purposes. A decoration mount assembly 40 which is suitable for the purpose may mount the decoration 48 on the assembly frame 2. In some embodiments, the decoration mount assembly 40 may include a mount block 41 which may be inserted in the mount block cavity 14 typically between the leg bevels 12 of the respective assembly frame legs 3*a*, 3*b*. The mount block 41 may be fractioned-fitted in the mount block cavity 14, or alternatively, may be secured in the mount block cavity 14 using at least one mount bolt 42 and securing nut 43. A decoration mount cone 46 may be fitted or mounted on the mount block 41. The decoration 48 may be mounted on the decoration mount cone 46. Accordingly, the decoration 48 imparts a desired festive appearance to the assembly 1 in the functional configuration of the assembly 1 illustrated in FIG. 1.

As illustrated in FIGS. 1 and 2, the light string or strings 50 may include any number and type of light strings which are commonly used for Christmas, Mardi Gras, Halloween, St. Patrick's Day or other tree decorations. Non-limiting examples of light strings 50 which are suitable for the purpose include icicle light strings or standard light strings with white, single-colored and/or multi-colored lights 51. The light strings 50 may be wound on the extended or deployed assembly frame 2 in a selected pattern and attached to the assembly frame legs 3 using staples, adhesive, clips, clamps, brackets and/or other suitable fastening techniques known by those skilled in the art. The light strings 50 may remain in place on the assembly frame 2 in folding of the assembly frame 2 to the transport or storage configuration. Additional non-lighted decorations (not illustrated) may be provided on the assembly frame 2 according to the tastes and preferences of the user.

Referring next to FIGS. 1, 2, 14 and 15 of the drawings, in typical application of the assembly 1, the assembly frame 2 may be deployed from the folded, non-functional transport or storage configuration of FIG. 2 to the extended, functional configuration on the supporting surface 52, as illustrated in FIG. 1. Accordingly, each opposing pivot assembly frame leg 3*a* and release assembly frame leg 3*b* may be deployed outwardly to the extended configuration, and the lower leg ends 4 of the respective assembly frame legs 3*a*, 3*b* may be rested on the supporting surface 52. The lower frame stabilizing members 18 may deployed in the connecting position by fastening the release end 20 of each lower frame stabilizing member 18 to the corresponding release assembly frame leg 3*b*, typically using the release bolt 23 and wing nut 24 as was heretofore described. In like manner, the upper frame stabilizing members 28 may be deployed in the connecting position typically by fastening the release end 30 of each upper frame stabilizing member 28 to the corresponding release assembly frame leg 3*b* typically using the release bolt 33 and wing nut 34. The decoration mount assembly 40 may be assembled on the upper end of the assembly frame 2 typically as heretofore described with respect to FIGS. 14 and 15. Accordingly, upon illumination of the lights 51 on the light strings 50, the assembly 1 imparts a festive appearance to the area in which the assembly 1 is deployed.

When use of the assembly 1 is completed, the lower frame stabilizing members 18 and upper frame stabilizing members 28 may be released from the respective release assembly frame legs 3*b* and suspended in place, as illustrated in FIGS. 8-11. The assembly frame legs 3*a*, 3*b* may be folded toward one another to the folded, non-functional transport or storage configuration illustrated in FIG. 2, in which storage configuration the assembly frame legs 3*a*, 3*b* may be disposed in parallel and adjacent relationship to each other. The release bolts 23 for the lower frame stabilizing members 18 and the release bolts 33 for the upper frame stabilizing members 28, with the respective wing nuts 24, 34, may be stowed in the bolt stowage openings 38 (FIG. 13) in the release assembly frame legs 3*b* and/or the pivot assembly frame legs 3*a*. The light strings 50 may remain in place on the assembly frame 2 throughout transport and/or storage of the assembly 1.

It will be appreciated by those skilled in the art that the foldable lighted tree assembly 1 is suitable for indoor or outdoor use. The assembly 1 requires little maintenance and can be customized according to the preferences and tastes of the user. Its foldable capability renders the assembly 1 amenable to space-efficient transport and storage. A user can utilize any desired combination of light strings 50 in any desired illumination pattern, color and/or style in order to create the desired festive appearance. The assembly 1 can be fabricated in a variety of sizes to accommodate all types of user needs and preferences. In some embodiments, one or more hinges (not illustrated) may pivotally attach the assembly frame legs 3*a*, 3*b* to each other according to the knowledge of those skilled in the art.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A foldable lighted tree assembly, comprising:

an assembly frame including a plurality of assembly frame legs having a first pair of opposing assembly frame legs disposed in a first plane and a second pair of opposing assembly frame legs disposed in a second plane perpendicular to the first plane and each of the plurality of assembly frame legs having a first leg end and a second leg end, the assembly frame legs of the first pair of opposing assembly frame legs and the assembly frame legs of the second pair of assembly frame legs converging at the second leg end;

the plurality of assembly frame legs selectively deployable between an extended, functional configuration wherein the assembly frame is generally pyramid-shaped and a folded, non-functional transport and storage configuration wherein the plurality of assembly frame legs are generally parallel and adjacent to each other;

at least one pair of frame stabilizing members releasably connecting each of the first pair of opposing assembly frame legs and the second pair of opposing assembly frame legs, each of the at least one pair of frame stabilizing members having a pivot end pivotally carried by a first one of the first pair of opposing assembly frame legs and the second pair of opposing assembly frame legs and a release end releasably connected to a second one of the first pair of opposing assembly frame legs and the second pair of opposing assembly frame legs;

a release bolt releasably attaching the release end to the second one of the first pair of opposing assembly frame legs and the second pair of opposing assembly frame legs;

at least one bolt storage opening in at least one of the plurality of assembly frame legs; and at least one light string having a plurality of lights supported by the assembly frame.

2. The foldable lighted tree assembly of claim 1 wherein the at least one pair of frame stabilizing members comprises two pairs of frame stabilizing members.

3. The foldable lighted tree assembly of claim 1 further comprising a decoration mount assembly carried by the second leg end of the plurality of assembly frame legs.

4. The foldable lighted tree assembly of claim 3 wherein the decoration mount assembly comprises a mount block carried by the plurality of assembly frame legs, a decoration mount cone carried by the mount block and a decoration carried by the decoration mount cone.

5. The foldable lighted tree assembly of claim 4 further comprising a plurality of leg bevels provided in the plurality of assembly frame legs, respectively, and a mount block cavity formed by and between the plurality of bevels, and wherein the mount block is disposed within the mount block cavity.

* * * * *